US008765246B2

(12) United States Patent
Möckli

(10) Patent No.: US 8,765,246 B2
(45) Date of Patent: Jul. 1, 2014

(54) STACK OR COLLECTION OF ESSENTIALLY FLAT PRIMARY PRODUCTS AND METHOD FOR PRODUCING SUCH A STACK OR SUCH A COLLECTION

(75) Inventor: Jürg Möckli, Bäretswil (CH)

(73) Assignee: Ferag AG, Hinwil (CH)

( * ) Notice: Subject to any disclaimer, the term of this patent is extended or adjusted under 35 U.S.C. 154(b) by 208 days.

(21) Appl. No.: 13/332,087

(22) Filed: Dec. 20, 2011

(65) Prior Publication Data

US 2012/0156426 A1 Jun. 21, 2012

(30) Foreign Application Priority Data

Dec. 20, 2010 (CH) ..... 2123/10

(51) Int. Cl.
*B42F 1/00* (2006.01)
*B42F 5/00* (2006.01)

(52) U.S. Cl.
CPC .... *B42F 1/00* (2013.01); *B42F 5/00* (2013.01)
USPC ..... 428/40.1; 428/121; 428/194; 428/198; 428/202

(58) Field of Classification Search
USPC ..... 428/40.1, 121, 124, 194, 198, 202
See application file for complete search history.

(56) References Cited

U.S. PATENT DOCUMENTS

| | | | | |
|---|---|---|---|---|
| 2,239,995 | A | 4/1941 | Daneke et al. | |
| 2,806,443 | A | 9/1957 | Horn et al. | |
| 3,759,373 | A | 9/1973 | Werth et al. | |
| 3,902,992 | A | 9/1975 | Schuster | |
| 4,743,005 | A | 5/1988 | Reist | |
| 5,096,176 | A | 3/1992 | Golicz et al. | |
| 5,193,851 | A | 3/1993 | Honegger | |
| 5,632,476 | A | 5/1997 | Stauber | |
| 6,286,712 | B1 * | 9/2001 | Craig et al. | 221/48 |
| 7,950,645 | B2 | 5/2011 | Stauber | |
| 2006/0065347 | A1 | 3/2006 | Silverbrook | |
| 2009/0191518 | A1 * | 7/2009 | Rappa | 434/129 |

FOREIGN PATENT DOCUMENTS

| | | | |
|---|---|---|---|
| CH | 461 248 | | 10/1968 |
| DE | 1 946 249 | | 2/1972 |
| DE | 37 05 257 | A1 | 10/1987 |
| EP | 0 409 770 | A2 | 1/1991 |
| EP | 0 631 946 | A1 | 1/1995 |
| EP | 0 666 186 | A1 | 8/1995 |
| EP | 1 252 083 | | 10/2002 |
| EP | 1 494 949 | | 1/2005 |
| EP | 1 762 525 | A1 | 3/2007 |
| EP | 1 780 035 | A2 | 5/2007 |
| EP | 2159070 | A1 | 3/2010 |
| EP | 2 179 952 | A1 | 4/2010 |

(Continued)

*Primary Examiner* — Alexander Thomas
(74) *Attorney, Agent, or Firm* — Pauley Petersen & Erickson

(57) ABSTRACT

The invention relates to a stack or a collection (10) of essentially flat primary products (11-14), in particular printed products, which stack or collection (10) comprises three or more primary products (11-14) which are arranged one immediately above the other in the stack or immediately side by side in the collection and are detachably joined together, and at least one of which is a printed product which has a folded edge.
Simple post-processing is achieved by adhesive areas (16) in contact respectively with both adjacent primary products being provided in order to form a detachable connection between adjacent primary products.

20 Claims, 7 Drawing Sheets

(56) References Cited

FOREIGN PATENT DOCUMENTS

| | | | |
|---|---|---|---|
| GB | 1 305 485 | | 1/1973 |
| GB | 2 106 033 | A | 4/1983 |
| WO | WO 01/56910 | | 8/2001 |
| WO | WO 03/086926 | A1 | 10/2003 |
| WO | WO 2007/067325 | A2 | 6/2007 |
| WO | WO 2007/085101 | | 8/2007 |
| WO | WO 2009/143645 | A1 | 5/2009 |
| WO | WO 2010/051650 | A1 | 5/2010 |
| WO | WO 2010/051651 | A2 | 5/2010 |

* cited by examiner

STACK OR COLLECTION OF ESSENTIALLY FLAT PRIMARY PRODUCTS AND METHOD FOR PRODUCING SUCH A STACK OR SUCH A COLLECTION

CROSS REFERENCE TO RELATED APPLICATION

Swiss Patent Reference 02123/10, filed 20 Dec. 2010, the priority document corresponding to this invention, and its teachings are incorporated, by reference, into this specification.

BACKGROUND OF THE INVENTION

1. Field of the Invention

The present invention relates to the field of print finishing. It relates to a stack or a collection of essentially flat primary products. It also relates to a method for producing such a stack or such a collection.

2. Discussion of Related Art

Advertising material such as leaflets, flyers, catalogues, hand bills, direct mail but also product samples, CDs etc. in the form of primary products are currently increasingly commonly being distributed directly by special service providers. Advertising material is often combined from different providers and distributed together in order to keep distribution costs low. The advertising material or primary products that are distributed together then form a stack of (individual) single copies lying loosely one on top of the other, or a collection of single copies lying side by side, which stack must be made up by hand in each case by the distributor at the delivery location. However, this manner of making up stacks is time-consuming and error-prone, so that either multiple copies of certain pieces of advertising material are contained in the stacks or collections formed, or the material is omitted altogether.

Stacks are here essentially understood to be combinations of primary products which lie one on top of the other and are held together by gravity. If the primary products are arranged in a different spatial orientation, for example lying vertically side by side, they are then referred to as a collection. The invention relates to such different manners of combining the primary products.

It is, however, also conceivable that the stacks of primary products are formed centrally and then passed on for distribution, as is disclosed, for example, in WO2010/051651 A2 filed by the Applicant. In this case, during distribution the primary products can easily shift inside a stack or stacks can be mixed up if special precautions are not taken to hold the individual stacks together and distinguished from one another.

It is thus, for example, possible to provide the stack of advertising material or primary products with a heat-sealed foil wrapper to hold the stack together and distinguish it from other stacks. Such an additional packaging for the stacks makes distribution considerably simpler but entails relevant additional expense and may be undesirable from an ecological point of view. Moreover, the heat-sealed foil bags are awkward for the end consumer to open and the overall impression is not particularly aesthetic, depending on the material used.

The stacks can, however, also be tied up or bundled up in a different way, for example with a wrapping. For example, it would be conceivable for the stack of primary products to be collected together with a band, as is disclosed, for example, in CH 461 248. However, the same disadvantages largely result here as were mentioned above.

Moreover, a method is disclosed in EP 0 666 186 A1 in which primary products are tipped into a folded newspaper which then functions as a wrapping for the tipped-in primary products and is then closed by means of one or more adhesive strips (see also WO 2007/067325 A2). To achieve this, a newspaper needs to be provided or a separate wrapping, which in turn significantly increases the expense.

Lastly, it is disclosed in U.S. Pat. No. 5,096,176 to separate individual part stacks of sheets from other part stacks in a larger combined stack by non-adhesive paper strips (column 1, lines 58-62) being placed around one edge of the respective part stack as separating strips. The intention hereby is to prevent the separating strips, which otherwise are laid flat between two part stacks, from shifting. Non-connecting separating strips of this type are suitable only for separating inside the combined stack as the separating strips immediately fall away when a part stack is itself individually transported or otherwise handled separately.

Another problem arises when multiple primary products are to be tipped into a folded newspaper as inserts. The document DE 37 05 257 A1 filed by the Applicant describes how, in a system, first the folded newspaper is fed into corresponding compartments with the folded edge pointing downwards and opened there, before the inserts are then injected individually, one after the other, into the open newspaper by feed conveyors arranged downstream. The newspaper with the inserts is then gripped by the grippers of a removal conveyor and conveyed away. If the inserts are to be tipped in at the same rate as the high production speed of the newspaper coming directly from the web-fed printing press, the inserts must be produced in advance and temporarily stored, for example in the form of reels, separately for each type of insert, before being removed from storage again so that they can be tipped in.

The method would be significantly simplified if, for example using a system as in the abovementioned WO2010/051651 A2 filed by the Applicant, first complete stacks of all the inserts or primary products provided for a newspaper are formed, then stored temporarily, again in the form of reels or the like, and finally removed from storage so that they can be tipped into the newspaper.

However, the drawback of such temporary storage is that the inserts or primary products combined to form a stack do not in themselves have sufficient cohesion to allow them to be temporarily stored and then removed from storage without any problems.

In a completely different technical field, namely that of multipacks for liquids, a multipack has been proposed (EP 0 631 946) in which the individual soft packages are held together with minimal complexity both in terms of production technology and materials. The joining together of the individual soft packages proposed therein using adhesive spots or adhesive strips of a hot-melt adhesive should be absolutely sufficient for the stresses to which they are subjected during transport, storage, stacking on the shelves of shops and handling by the customers until the packs are broken up. In contrast to multi-page printed products such as, for example, brochures, the soft packages are self-contained inherently stable bodies which cannot be fanned out or folded or lose their shape in some other way. Problems with the place and type of application, and the existing product-specific requirements, are fundamentally different from the local technical field of print finishing.

This applies to an even greater extent to dimensionally stable packaging units such as, for example, those disclosed in U.S. Pat. No. 3,759,373 or U.S. Pat. No. 3,902,992.

On the other hand, it is known from the field of producing blocks of identical individual sheets of paper of the same size (sets of forms, notepads, pads of sticky notes, etc.) to join together the individual sheets of paper with an adhesive which is either introduced into holes punched beforehand along one edge (see, for example, DE 1 946 249 or GB 2 106 033) or applied to the edges of the sheets of paper on one or both sides, the sheets of paper then being laid one on top of the other and glued together (see, for example, US 2006/0065347). Such a type of binding is limited in the prior art to stacks of individual sheets of paper of the same format and same thickness. Moreover, there are no solutions here which can be applied to primary products with continuous/sequential processing in the context of print finishing.

In the field of print finishing, adhesive joining methods are, for example, used where (folded) partial products are collated by being laid one on top of the other (see, for example, EP 0 409 770 A2 filed by the Applicant) or where individual inserts are tipped into a newspaper or a comparable printed product and fixed there (see, for example, EP 1 780 035 A2 filed by the Applicant).

SUMMARY OF THE INVENTION

The object of the invention is therefore to provide a pre-assembled stack or a pre-assembled collection of partially folded flat primary products which have the same or different formats, which are easy to produce, are easy to handle in the context of a post-processing operation and can later easily be split up again into the individual primary products. The object of the invention is also to provide a method for producing stacks or collections of this type.

The stack or collection of essentially flat primary products according to the invention comprises three or more primary products which are arranged one immediately on top of the other in the stack or immediately side by side with one another in the collection and are detachably joined together, and at least one of which is a primary product which has a folded edge. They are characterized in that adhesive areas in contact respectively with both adjacent primary products are provided in order to detachably join together adjacent primary products.

It is essential in order to understand the invention that, in contrast to the other ways of adhesively joining printed products, it is concerned with the abovementioned primary products in the context of a continuous post-processing operation or an overall logistical process. They form independent finished units in terms of both content and format which are broken up again by the end user and used separately. In contrast to, for example, book binding, the primary products do not match one another and in the prior art were, up until now, handled completely separately as part of the post-processing operation.

According to an embodiment of the invention, the adhesive areas are designed as local adhesive spots and/or local adhesive beads and/or double-sided adhesive elements.

In particular, the adhesive areas or adhesive spots or adhesive beads are applied by means of a dispensing device. Dispensing devices of this type, which apply the adhesive through a nozzle with the assistance of pressure and/or temperature, are known from the prior art. The adhesive areas can also be applied by rolling or by printing by means of an appropriate printing device.

Another embodiment is characterized in that the adhesive areas or adhesive spots or adhesive beads contain an adhesive which allows the joined-together primary products to be separated later without these primary products being damaged. There are many types of this kind of adhesive known from the prior art. Moreover, adhesive elements or adhesive areas can be used which have detachability properties that differ locally.

A further embodiment is characterized in that the primary products have discrete edges, in that the primary products in the stack or in the collection are arranged one on top of the other, or one next to the other, in such a way that the discrete edges of the primary products in the stack or in the collection form a common edge, and in that the adhesive areas or adhesive spots or adhesive beads are arranged distributed along and adjacent to the common edge. In particular, the folded edges of folded primary products form such discrete edges, which make it much easier to join the primary products together to form a unit which can be handled easily.

In particular, the individual primary products of the stack differ in format and/or thickness and/or type of product. However, the primary products can also, in special cases, all be the same.

Furthermore, in particular at least one of the primary products is a printed product.

The method according to the invention for producing a stack or a collection is characterized in that in a first step a first primary product is supplied, in that in a second step the supplied first primary product is provided on at least one side with adhesive areas at predetermined points, in that in a third step at least one second primary product is detachably joined to the first primary product by means of the applied adhesive areas, and in that steps two and three are repeated with further primary products until the desired stack or the desired collection has been made up and joined together.

The primary products are preferably each provided locally with the adhesive areas by means of a dispensing device. The adhesive areas can also be applied by rolling or printing by means of an appropriate printing device.

In particular, the adhesive areas are applied as adhesive spots and/or adhesive beads and/or adhesive elements.

An adhesive is advantageously used here which allows the joined-together primary products to be separated later without these primary products being damaged.

In particular, the adhesive areas can be applied with an adhesive in such a way that, when the stack is separated later into the individual primary products, the adhesive comes loose only on one predetermined side, or the adhesive area remains intact only on one of the two primary products, while the other primary product has no adhesive on it. It is, however, also conceivable that the adhesive areas split when the primary products are separated and part of the adhesive remains on each of the two primary products.

In particular, in order to assemble the stacks or collections, an assembly device can be used which is designed in the manner of a circulating transport device, wherein inclined compartments, placed in succession on the upper feed section, are made available and led past feed conveyors which take the primary products for forming the stack from primary product hoppers and introduce them one after the other in the desired sequence into the compartments, and wherein between two stations the adhesive areas are in each case applied to the respective upper primary product. Comparable stack-formation or assembly devices are disclosed in the documents WO 2010051651 and WO 2010051650 filed by the Applicant. According to a further development of the method according to the invention, the combined stacks or collections of the primary products which are joined adhesively together are each tipped into a further primary product, in particular a printed product, as is described in a similar fashion in the document WO 2009143645 filed by the Applicant. It is advantageous here if the combined stacks or collections of the primary products which are joined adhesively together are first temporarily stored and the temporarily stored stacks or collections are removed from storage at a later point in time and tipped into the other primary products. It is hereby possible to disassociate the production of the primary products combined to form the stack or collection from the production of the other primary products which receive the stacks or collections.

In particular, it has been proven that the stacks or collections can be wound up to form a reel and temporarily stored as a reel, wherein the stacks or collections can be wound onto the reel in the form of a shingle stream or with a gap from one another. Corresponding winding methods and devices are described in the documents EP 1 252 083 and EP 1 494 949 filed by the Applicant.

BRIEF DESCRIPTION OF THE DRAWINGS

The invention is explained in more detail below with the aid of exemplary embodiments and in conjunction with the drawings, in which:

FIG. 7 shows a diagrammatic view of a tipping-in device for tipping the stacks according to the invention into a newspaper or the like.

DESCRIPTION OF PREFERRED EMBODIMENTS

Figure 1:
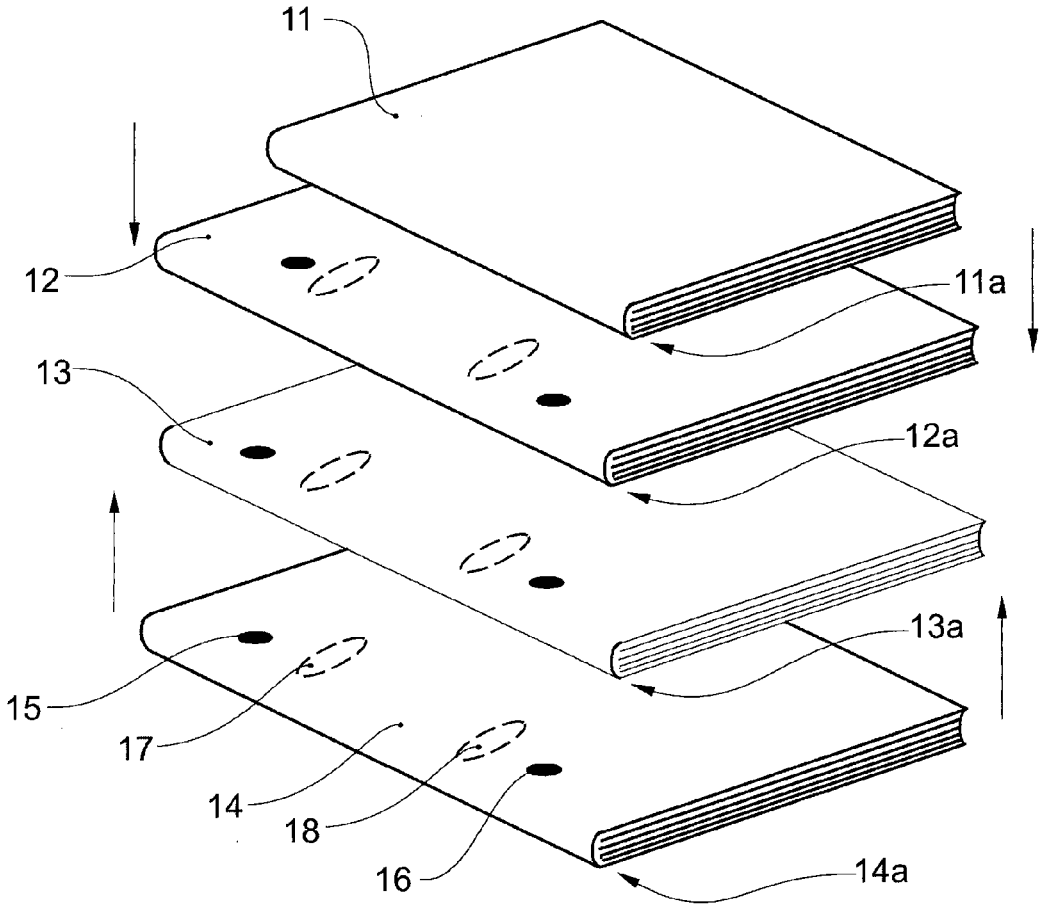
FIG. 1 shows a simplified exploded view of multiple folded primary products, ready to be collected according to the invention, which according to an exemplary embodiment of the invention are provided with adhesive spots or adhesive beads, before they are joined together to form a stack.
Figure 2:
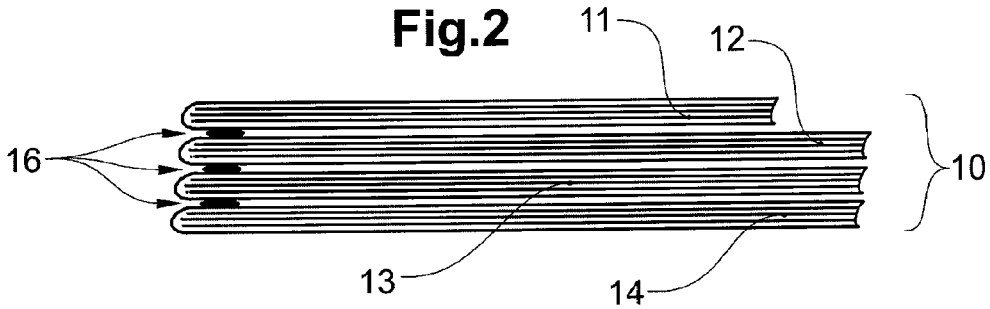
FIG. 2 shows a side view of the joined-together stack according to FIG. 1.

FIG. 1 shows a simplified exploded view of multiple folded primary products 11-14, ready to be collected according to the invention, which according to an exemplary embodiment of the invention are provided with adhesive spots 15, 16 and/or adhesive beads 17, 18 (in broken lines), before they are joined together to form a stack (10 in FIG. 2). The primary products 11-14 shown in the example are, for the sake of simplicity, all shown as being of the same type but with different formats. They are all folded along a folded edge 11*a*-14*a* and here have the same thickness. The top primary product 11 has a smaller format than the other primary products 12-14, which all have the same larger format. It is self-evident that the primary products can not only all have a different format but also be of different types and thicknesses and be made from different materials. Individual primary products can thus be a card, a hand bill or a CD or a product sample or the like.

In order to form the stack 10 or a corresponding collection, the individual primary products 11-14 are aligned relative to one another with a selected edge, which in the example in question is preferably the folded edge 11*a*-14*a* of the primary products 11-14, so that the stack 10 as a whole forms a uniform edge by which the stack 10 can be grasped easily and securely as part of a post-processing or handling operation. This is particularly advantageous if the formats of the primary products differ significantly from one another.

The primary products 11-14 are joined together to form a stable stack 10 by the local application of a suitable adhesive in the form of one or more adhesive spots 15, 16 and/or adhesive beads 17, 18 (shown in broken lines in FIG. 1) by means of an appropriate dispensing device (19, 20 in FIG. 3). Adhesive spots 15, 16 are formed especially when the dispensing devices 19, 20 are essentially stationary relative to the primary product during the application of adhesive. If, however, the primary product is moved relative to the dispensing devices 19, 20 with sufficient speed when the adhesive is applied, elongated adhesive beads 17, 18 are formed which, depending on the direction of movement, can be oriented parallel, transversely or obliquely relative to the folded edge 11*a*-14*a*. It is of course also conceivable that a row of adhesive spots, one after the other, can be applied instead of the adhesive beads 17, 18 if the dispensing devices 19, 20 are switched alternately on and off as they move, or that one adhesive bead can be created by moving the dispensing devices 19, 20.

The adhesive is here preferably applied in the immediate vicinity of the selected edges in order to ensure that there is minimal disruption to the appearance of the primary products after they have been separated subsequently. The adhesive can—as shown in FIG. 1—in each case be applied on only one side of a primary product, this side always being oriented in the same way. If the application of the adhesive begins on the lowermost primary product 14 in the stack, in this type of application the top primary product 11 of the stack can remain without any adhesive applied. It is, however, also conceivable for individual primary products to be provided with adhesive on both sides. It is essential that, overall, there is always an application of adhesive between each pair of adjacent primary products.

Depending on the type of adhesive used, the procedure takes different forms. If the adhesive is a hot-melt adhesive, the primary products in the stack must be brought together before the adhesive cools. If the adhesive is a contact adhesive, it is applied to both sides and the primary products are subsequently pressed together briefly. Polyurethane adhesives can, however, also be used, as in bookbinding. Moreover, different types of single-component adhesives or two-component adhesives can be used. Within the scope of the invention, it is, however, also conceivable to use and apply pieces of adhesive foil or film on both sides as adhesive areas for joining together adjacent primary products in the manner of a double-sided adhesive tape ("adhesive elements" in the form of a portion of adhesive tape, a spot of adhesive, a ring of adhesive or other shapes), which are for example supplied on a backing tape, detached from the backing tape and then applied.

Advantageously, such adhesives are especially those which allow the primary products to be separated from one another subsequently without damaging the primary products concerned. In this way, it can be ensured that the external appearance, which is particularly important for printed products, is not damaged by the application of adhesive, or only negligibly. It is thus possible to specifically select the adhesion of the sides, especially when a double-sided adhesive element is used, so that the adhesive area is detached from one primary product (thus in particular on the respective upper side of a primary product shown in FIG. 2, i.e. on its cover sheet) and remains sticking to the other primary product (therefore, in FIG. 2 in the example mentioned, on the rear side of the respective uppermost product). According to the invention, it is thus possible to ensure that the cover sheet side which is relevant for the respective primary product is visible for the end customer or reader without being affected, i.e. without any disruptive adhesive residues, when the collection is separated. A corresponding effect can also be obtained by a suitable application of an adhesive area, such as for example by an adhesive which has special adhesion properties depending on the timing of the application (for example, by corresponding fluctuations in temperature). This result can thus be achieved, according to the method, by applying the adhesive area first to the top primary product at a temperature $T_1$ and then joining it to a lower primary product at an adhesive temperature $T_2$. In particular when making use of this advantageous effect, it has been shown that each of the primary products in the stack or the collection, within the scope of the invention, assumes a separate and autonomous or individual significance (including the arrangement and orientation of the individual primary products). It can also be seen in FIG. 2 that the resulting collection according to the invention has no wrapping, and that neither the top nor the bottom primary product have any devices on the visible surface but nevertheless the collection has the desired separable cohesion.

FIG. 3 shows different steps in the joining together of the primary products to form a stack according to the invention. Starting with a first primary product 14 situated at the bottom of the stack (FIG. 3*a*), a first application of adhesive is made on the upper side of this first primary product 14 in the form of adhesive spots 15, 16 by the corresponding dispensing devices 19 and 20 (FIG. 3*b*). The next primary product 13 can then be placed adhesively on top of the primary product 14 and joined to said primary product 14 (FIG. 3*c*). Adhesive spots 15, 16 are then in turn applied in the same way to the upper side of the second primary product 13, and then serve to join it to the next primary product, not shown in FIG. 3. The sequence of steps shown is then repeated (see FIGS. 3*e* and 3*f*) until the whole stack of the primary products has been completed. It is, however, equally conceivable that a different sequence can be followed, where the application of adhesive is made in each case to the underside of the primary product placed on the top of the stack, while the upper side of the primary product situated at the bottom does not receive an application of adhesive.

Figure 3A:
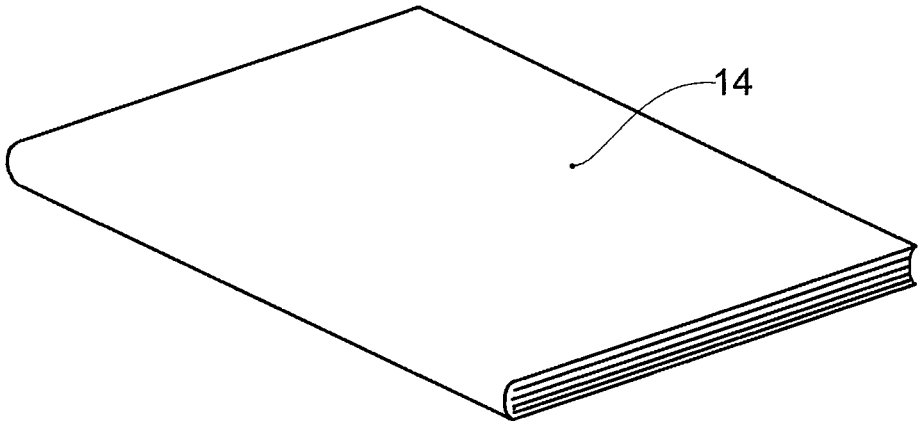
FIGS. 3*a-f* show individual steps in the preparation and joining together of the stack according to FIG. 2.
Figure 3B:
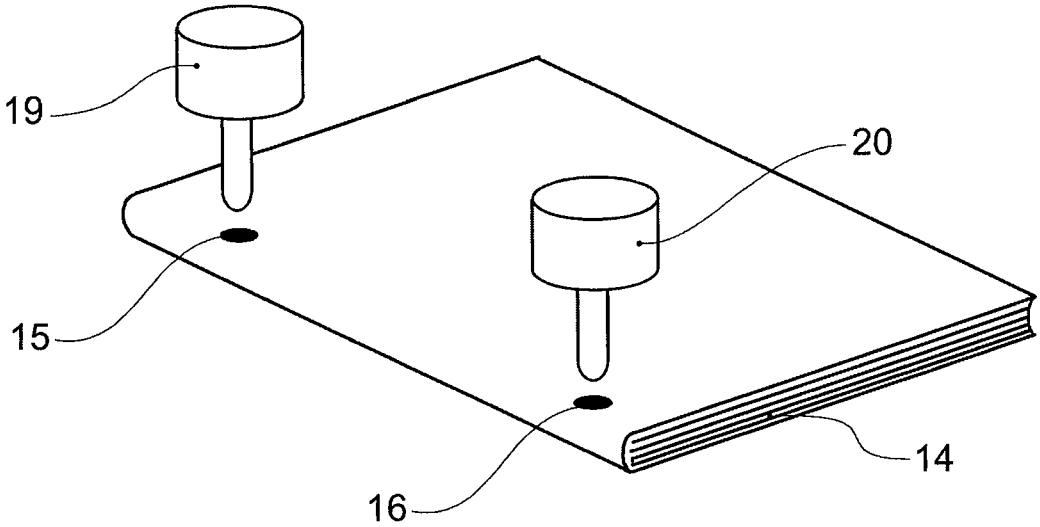
Figure 3C:
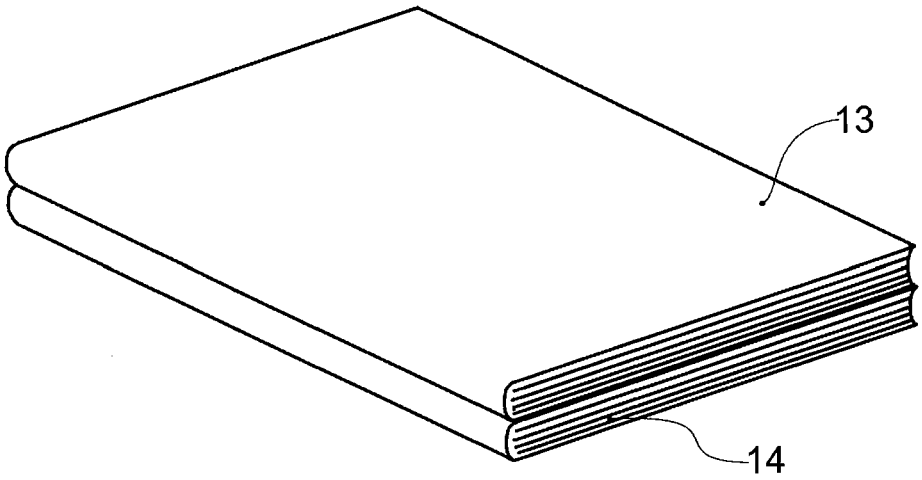
Figure 3D:
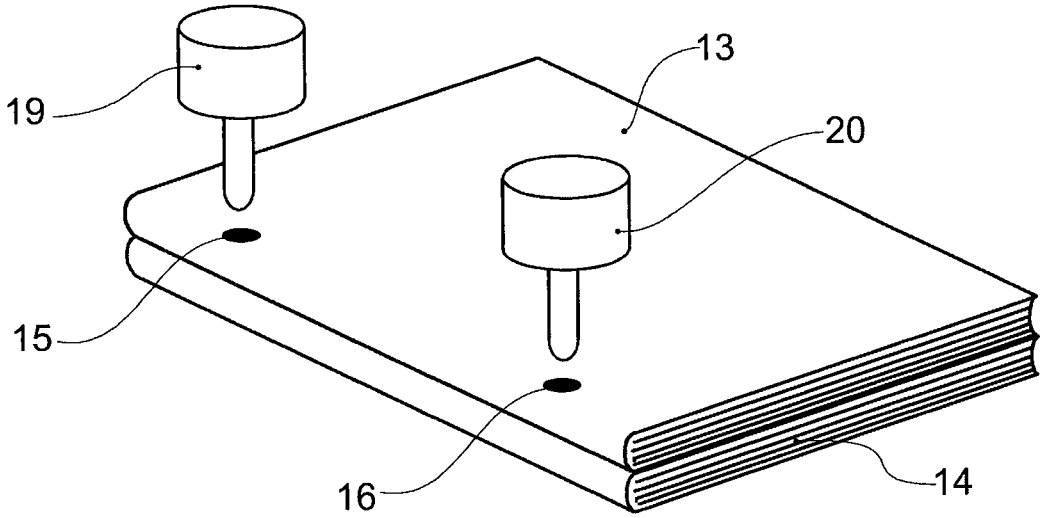
Figure 3E:
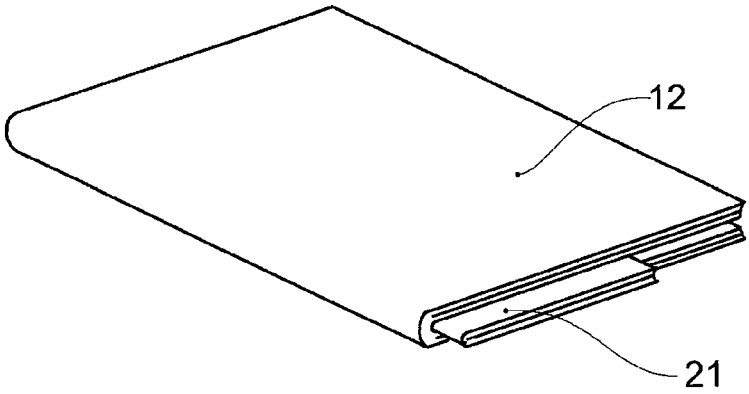
Figure 3F:
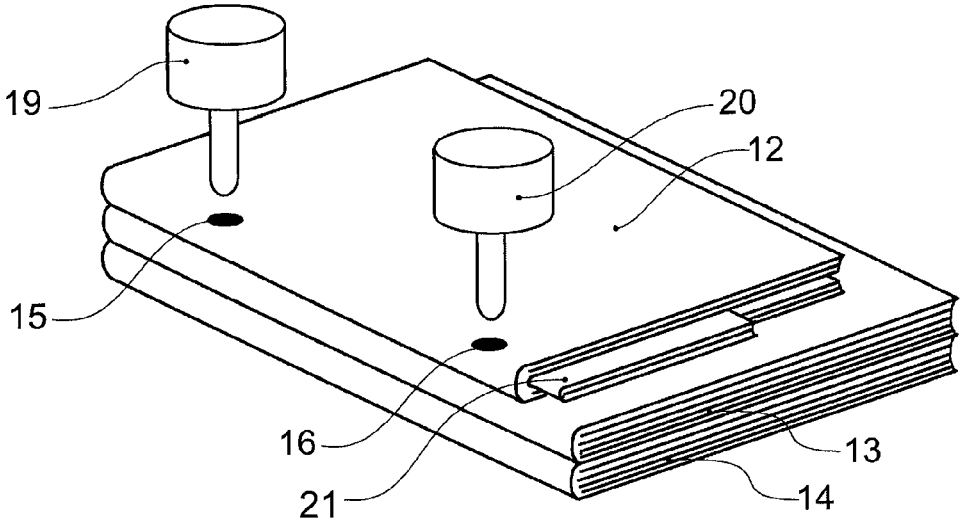

The primary products combined to form the stack 10 can for their own part already have other primary products 21 tipped in, as shown in FIGS. 3*e* and 3*f* for the primary product 12 placed on top of the stack as the next primary product.

Although, as explained above within the scope of the preferred method according to the invention, a stepwise application of the adhesive areas (also comprising adhesive elements) or a stepwise adhesive bonding together of the primary products is provided, in an alternative embodiment of the method a (virtually) simultaneous application onto the primary products and a (more or less) simultaneous adhesive bonding together of the three or more printed products can also be provided. This can, for example, be effected by collating the collection, fanning it out wide at the aligned edges and applying the adhesive areas in or between the primary products.

Figure 6:
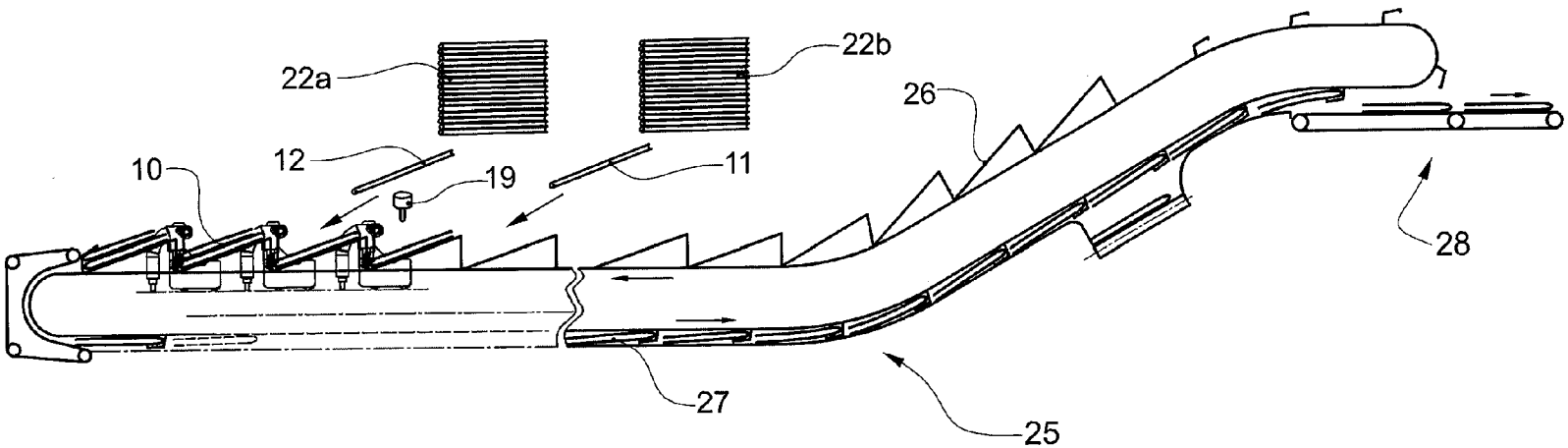
FIG. 6 shows a diagrammatic view of an assembly device for assembling the stacks according to the invention.

An assembly device 25 for joining the primary products 11-14 together to form a corresponding stack 10 is shown diagrammatically by way of example in FIG. 6. The assembly device 25 is designed in the fashion of a circulating belt-like transport device. This transport device circulates in FIG. 6 continuously in a clockwise direction. Inclined compartments 26, placed in succession on the upper feed section, are made available and led past feed conveyors which take the primary products 11, 12 for forming the stack from primary product hoppers 22*a*, 22*b* and introduce them one after the other in the desired sequence into the compartments 26, wherein between two stations adhesive spots or adhesive areas are in each case applied to the respective upper primary product by means of corresponding dispensing devices 19 (for the sake of simplicity, only two of the three or more primary products 11 and 12 are shown here).

If the stacks 10 at the end of the feed section are complete, they are grasped by the grippers 27 associated with the compartments 26 and in the lower return section are transported to a removal conveyor 28 at the right-hand side of the figure, which then supplies the stacks for further use.

The stack 10 according to FIG. 2, completed in the manner described, can undergo a wide range of different post-treatment or post-processing operations. It is thus conceivable to bundle and/or palletize the stacks 10 and deliver them to the end user. It is, however, also conceivable to store the stacks 10 temporarily in a temporary store, for example rolled up in shingle form to form a reel or combined in a larger stack, so that they can later be removed from storage again and used further in the context of a print finishing process. An example of such a procedure is shown in a highly simplified manner in FIG. 4 and FIG. 5, respectively.

The stacks 10 or collections formed in this way are highly advantageous, in particular in high-speed processes (processing at a rate of five, ten or more products per second) or in the case of stacks with a complex formation, especially if it is important that the primary products are aligned precisely relative to one another for the post-processing, or if, in a post-processing step, there is the undesired possibility of the primary products of one collection becoming "mixed up" with those of another collection, or there is a situation where the separation of adjacent collections is problematic.

Figure 4:
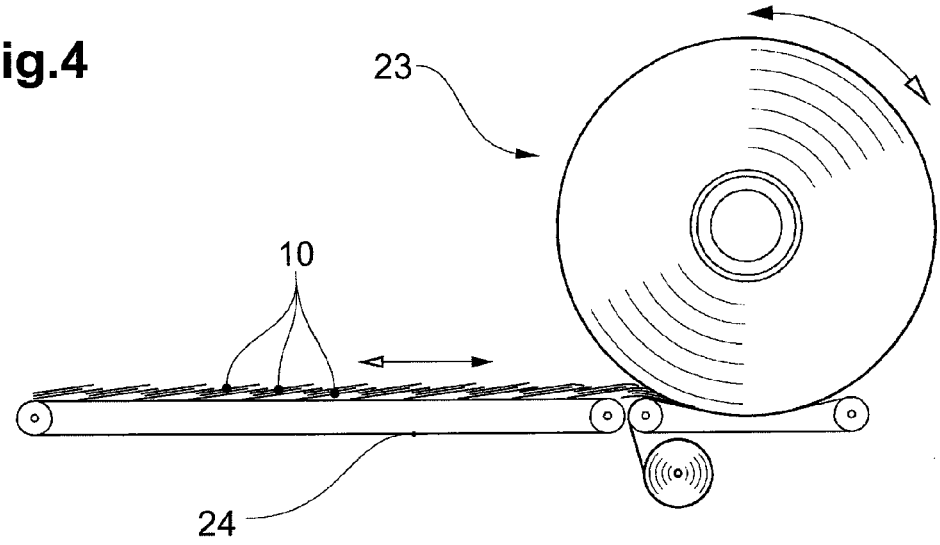
FIG. 4 shows a diagrammatic view of a first device for temporarily storing the stacks according to the invention.
Figure 5:
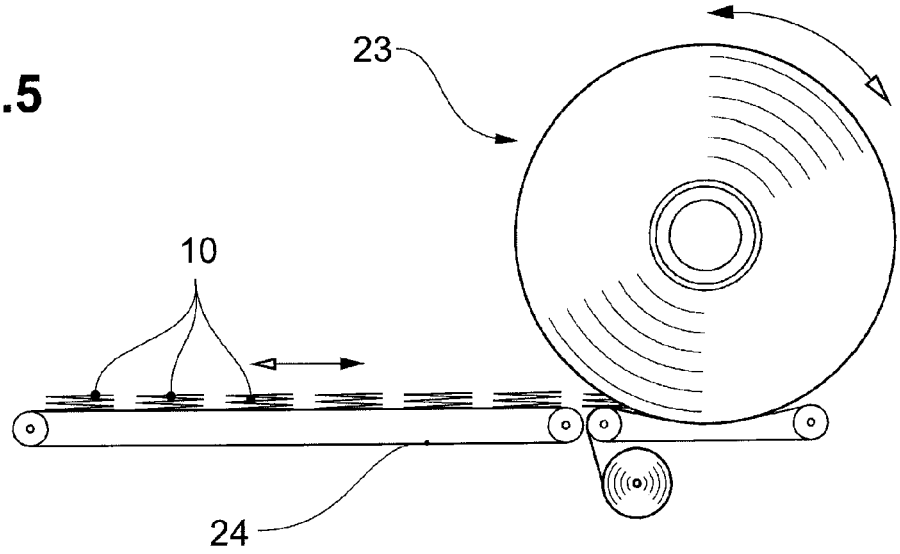
FIG. 5 shows a diagrammatic view of a second device for temporarily storing the stacks according to the invention.

In FIG. 4, the process starts with already complete stacks 10. The complete stacks 10 are transported by means of a transport device 24 in a shingle stream to a winding device known per se and there wound up to form a reel 23. According to FIG. 5, instead of a shingle stream of stacks 10, the stacks 10 can, however, also be wound up separately from one another to form a reel 23.

In newspaper printing, this process can be carried out in the course of the day at a time when no newspapers are being printed. In this way, staff and machinery which are otherwise involved in printing newspapers can be used to assemble the stacks.

If the printing of newspapers then starts again later, the stacks 10, which in this case contain inserts for the newspaper as primary products, can be removed from storage again by unrolling the reel 23 (divided into collections, i.e. with the possibility of very simply separating the collections again precisely) and tipped into the open newspapers or other types of printed products which are moved past. Compared with the tipping-in of the individual primary products or inserts, as described in the document DE 37 05 257 A1 mentioned at the beginning, the advantage arises hereby that the removal of the primary products from storage does not need to be performed and monitored individually by staff assigned for the purpose. This is particularly important during the ongoing printing of newspapers as the complete attention of the operating staff is required at this point in the printing process with its subsequent finishing stage. By virtue of the formation of stacks and temporary storage at an earlier point in the process, the expensive operation and monitoring of the individual feed conveyors can thus take place at a time where not all resources are required for newspaper printing.

Figure 7:
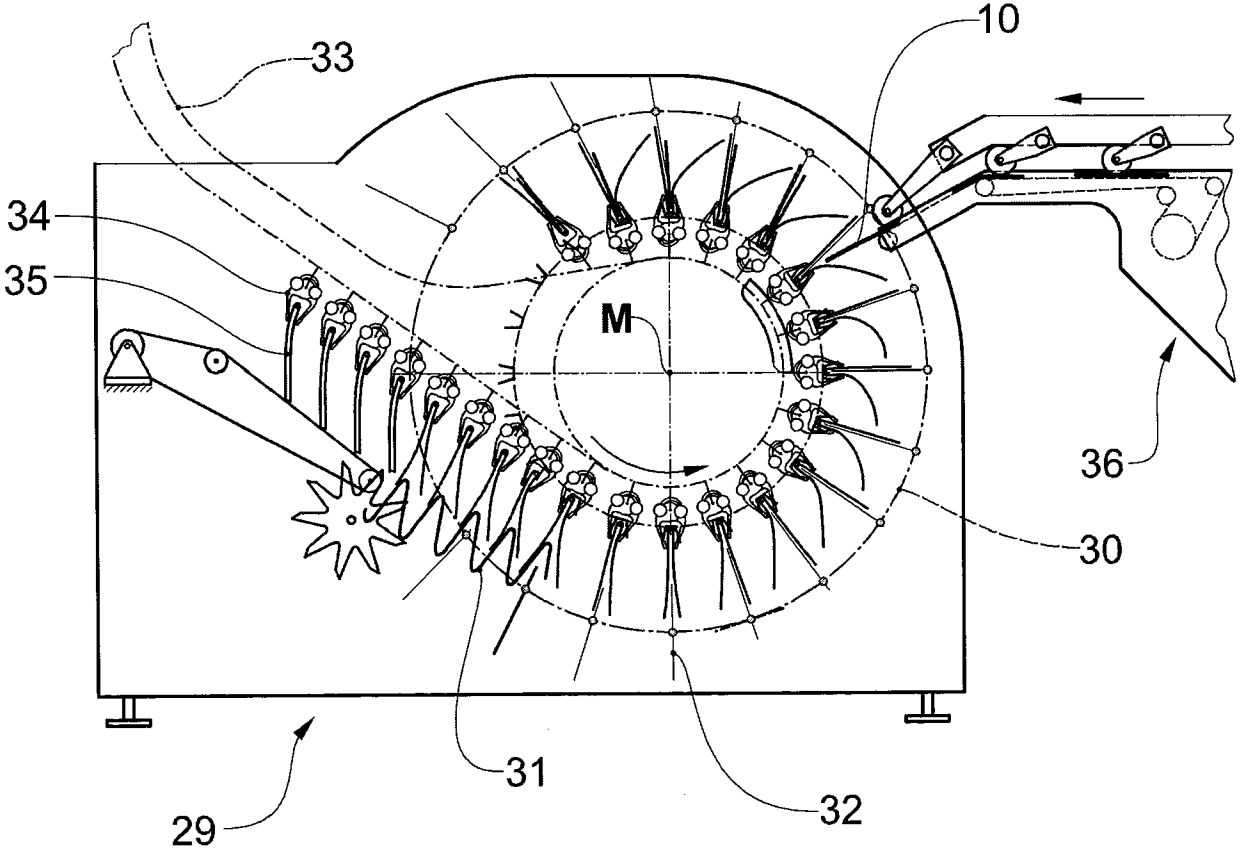

FIG. 7 shows a tipping-in device 29 which is suitable for tipping the stacks 10 into a newspaper 35 or a comparable printed product. The tipping-in device 29 comprises a drum 30, rotating about a machine axis M, with support elements, into which drum the newspapers 35 are introduced in a continuous sequence by a circulating conveying device 33 equipped with grippers 34. When they enter the drum 30 with support elements, the hanging newspapers 35 held by the folded edge are spread open by an opening device 31 and are kept open by introducing support elements 32 into the open newspapers 35 as they continue to circulate inside the drum 30 with support elements, so that the stacks 10 can be tipped individually into the open newspapers 35 by a downstream feed conveyor 36.

I claim:

1. A stack (10) of generally flat primary products (11-14), which stack (10) comprises:

three or more primary products (11-14) which are arranged one immediately above the other in the stack or collection and are detachably joined together, and at least one of which is a primary product which has a folded edge (11*a*-14*a*), wherein adhesive areas (15-18) in contact respectively with both adjacent primary products are provided to form a detachable connection between adjacent primary products, wherein the individual primary products (11-14) of the stack (10) differ in format and/or thickness and/or type of product, and at least one of the primary products (11-14) is a printed product.

2. The stack according to claim 1, wherein the adhesive areas (15-18) are designed as local adhesive spots (15, 16) and/or local adhesive beads (17, 18) and/or adhesive elements.

3. The stack according to claim 1, wherein the adhesive areas (15-18) are applied by means of a dispensing device.

4. The stack according to claim 1, wherein the adhesive areas (15-18) contain an adhesive which allows the joined-together primary products (11-14) to be separated later without these primary products (11-14) being damaged.

5. The stack according to claim 1, wherein the primary products (11-14) have discrete edges (11*a*-14*a*) and the primary products (11-14) in the stack (10) are arranged one on top of the other in such a way that the discrete edges (11*a*-14*a*) of the primary products (11-14) in the stack (10) form a common edge, and the adhesive areas (15-18) are distributed along and adjacent to the common edge.

6. A method for producing the stack or a collection (10) according to claim 1, further comprising:

supplying a first primary product (14);

providing the supplied first primary product (14) on at least one side with adhesive areas (15, 16 or 17, 18) at predetermined points;

detachably joining at least one second primary product (13) to the first primary product (14) by the applied adhesive areas (15, 16 or 17, 18), wherein the providing step and the joining step are repeated with further primary products (12, 11) until the desired stack or the desired collection has been made up and joined together.

7. The method according to claim 6, wherein the primary products (12-14) are each provided locally with the adhesive areas (15, 16 or 17, 18) by means of a dispensing device (19, 20).

8. The method according to claim 7, wherein the adhesive areas are applied as adhesive spots (15, 16) and/or adhesive beads (17, 18).

9. The method according to claim 6, wherein an adhesive is used which allows the joined-together primary products (11-14) to be separated later without these primary products (11-14) being damaged.

10. The method according to claim 6, further comprising:

using an assembly device (25) to assemble the stacks (10), the assembly device (25) comprising a circulating transport device, wherein inclined compartments (26), placed in succession on the upper feed section, are made available and led past feed conveyors which take the primary products (11, 12) for forming the stack from primary product hoppers (22*a*, 22*b*) and introduce them one after the other in the desired sequence into the compartments (26), and wherein between two stations the adhesive areas (15, 16 or 17, 18) are in each case applied to the respective upper primary product.

11. The method according to claim 6, wherein the combined stacks (10) of the primary products (11-14) which are joined adhesively together are each tipped into a further primary product, in particular a printed product (35).

12. The method according to claim 11, wherein the combined stacks (10) of the primary products (11-14) which are joined adhesively together are first temporarily stored, and the temporarily stored stacks or collections (10) are removed from storage at a later point in time and tipped into the other primary products (35).

13. The method according to claim 12, further comprising:

winding the combined stacks (10) to form a reel (23) and temporarily storing the reel (23).

14. The method according to claim 13, further comprising:

winding the combined stacks (10) onto the reel (23) in the form of a shingle stream.

15. The method according to claim 13, further comprising:

winding the combined stacks (10) onto the reel (23) with a gap from one another.

16. The stack according to claim 1, wherein the individual primary products (11-14) of the stack (10) differ in at least two of: format, thickness, and type of product.

17. The stack according to claim 1, wherein the individual primary products (11-14) of the stack (10) differ in format and thickness and type of product.

18. A stack (10) of generally flat primary products (11-14), which stack (10) comprises:

three or more primary products (11-14) which are arranged one immediately adjacent an other in the stack or collection and are detachably adhered together, and at least one of the primary product is a printed product which has a folded edge (11*a*-14*a*), each of the three or more primary products (11-14) adhered to at least one adjacent other of the three or more primary products (11-14) by an adhesive area (15-18) in contact respectively with both adjacent primary products to form a detachable connection between the adjacent primary products, wherein at least one of the individual primary products (11-14) of the stack (10) differs in format and/or thickness and/or type of product.

19. The stack according to claim 18, wherein at least one of the individual primary products (11-14) of the stack (10) is a card, leaflet, flyer, catalogue, hand bill, direct mail, product sample, or CD.

20. The stack according to claim 18, wherein the each of the three or more primary products (11-14) is adhered to the at least one adjacent other of the three or more primary products (11-14) by spaced apart adhesive areas each including an adhesive spot (15, 16) and/or a local adhesive bead (17, 18) and/or an adhesive element.

* * * * *